United States Patent [19]

McCarthy

[11] 4,274,949

[45] Jun. 23, 1981

[54] FROTH SEPARATION APPARATUS

[76] Inventor: James R. McCarthy, c/o Coal Inc. 6417 Loisdale Rd., Springfield, Va. 22150

[21] Appl. No.: 78,591

[22] Filed: Sep. 24, 1979

[51] Int. Cl.[3] ..... B03B 7/00; B03D 1/14

[52] U.S. Cl. ..... 209/17; 209/168

[58] Field of Search ..... 209/164, 165, 168-170, 209/13, 17, 1, 5, 268, 370, 250, 44, 454, 380, 273; 210/221 R, 221 P

[56] References Cited

U.S. PATENT DOCUMENTS

| | | | |
|---|---|---|---|
| 181,216 | 3/1868 | Rice | 209/370 X |
| 719,913 | 2/1903 | Wackerow | 209/250 X |
| 1,394,306 | 10/1921 | Mynps | 209/169 |
| 1,420,138 | 6/1922 | Peck | 209/165 X |
| 2,130,144 | 9/1938 | McClave | 209/164 X |
| 2,163,927 | 6/1939 | Wright | 209/17 X |
| 2,221,008 | 11/1940 | Thaylor | 209/169 |
| 2,411,288 | 11/1946 | Morse | 209/164 |
| 3,009,576 | 11/1961 | Jones | 209/268 |
| 3,024,911 | 3/1962 | Janson | 209/268 |

FOREIGN PATENT DOCUMENTS

| | | | |
|---|---|---|---|
| 96217 | 10/1923 | Austria | 209/169 |
| 712920 | 7/1965 | Canada | 209/250 |
| 41615 | 3/1924 | Norway | 209/17 |
| 310049 | 7/1971 | U.S.S.R. | 209/1 |

*Primary Examiner*—Robert Halper

*Attorney, Agent, or Firm*—Buell, Blenko, Ziesenheim & Beck

[57] ABSTRACT

A froth separation apparatus is provided having a separation container of generally rectangular form having two spaced generally parallel vertical sides, two generally parallel ends and a bottom, an influent feed delivering a suspension of solids in liquid at spaced points along the top of the separation container, a reagent inlet into the influent feed in advance of the separation container, diagonal froth retention screen means extending across the separation container from end to end and from a line intermediate the top and bottom of one side wall to a line adjacent the bottom of the other side wall, froth creating means in the separation container above said screen means, a weir discharge means on the said other side wall at the bottom thereof adjacent the screen means line for removal of froth and outlet means at the bottom of said one side for tailings discharge.

8 Claims, 3 Drawing Figures

FROTH SEPARATION APPARATUS

This invention relates to froth separation apparatus and particularly to apparatus for creating and separating froth from a fluid suspension such as is used in froth flotation processes.

The use of froth flotation techniques for separating one member of a mixture of materials in suspension is old and well known in the mineral dressing and related arts. Froth flotation is a technique used in separating a great variety of metal values from the gangue or tailings. Similarly, a great variety of apparatus has been used to accomplish this froth flotation separation. In general, these apparatus provide a means for introducing into a liquid suspension a frothing agent capable of forming an air bubble and attaching it to the material which is desired to be separated by flotation so that as the air bubbles rise to the top of the suspension they carry the material onto the top of the suspension in a floating froth. Usually such apparatus takes the form of a long trough with some means for introducing the suspension to be treated at one end along with the frothing agent and then introducing air into the system along the trough length to create a floating froth and finally skimming the froth from the suspension at the discharge end of the trough.

The conventional apparatus of the prior art is thus generally quite long and requires a considerable amount of space as well as being generally expensive to construct.

I have invented a froth separation apparatus which is simple in operation and construction and eliminates many of the problems of earlier froth separation devices.

I provide an apparatus which comprises a separation container of generally rectangular form having two spaced generally parallel vertical side walls, two generally parallel end walls and a bottom, influent feed means delivering influent suspension at spaced points along the top of the separation container, a reagent inlet into the influent feed in advance of the separation container, diagonal screen means extending across the separation container from end to end and from a line intermediate the top and bottom of one side wall to a line adjacent the bottom of the other side wall, froth creating means in the separation container above said screen means, a froth discharge means on said other side wall at the bottom thereof between said screen means and said other side wall, and outlet means at the bottom of said one side for tailings discharge. Preferably, the froth creating means is an agitating and aerating means such as a plurality of substantive parallel screens extending across the separation container above the screen means onto which the influent feed delivers the suspension of solids and liquids. The froth discharge means is preferably a weirtype discharge at the bottom of said other side, extending along the bottom of said other side from end to end. Preferably, the screen means extends to a line on the bottom adjacent said other side. The bottom preferably slopes away from said line where the screen means terminates to the effluent discharge opening.

In the foregoing general description of my invention I have set out certain objects, purposes and advantages. Other objects, purposes and advantages will be apparent from a consideration of the following description and the accompanying drawings in which.

Figure 1:
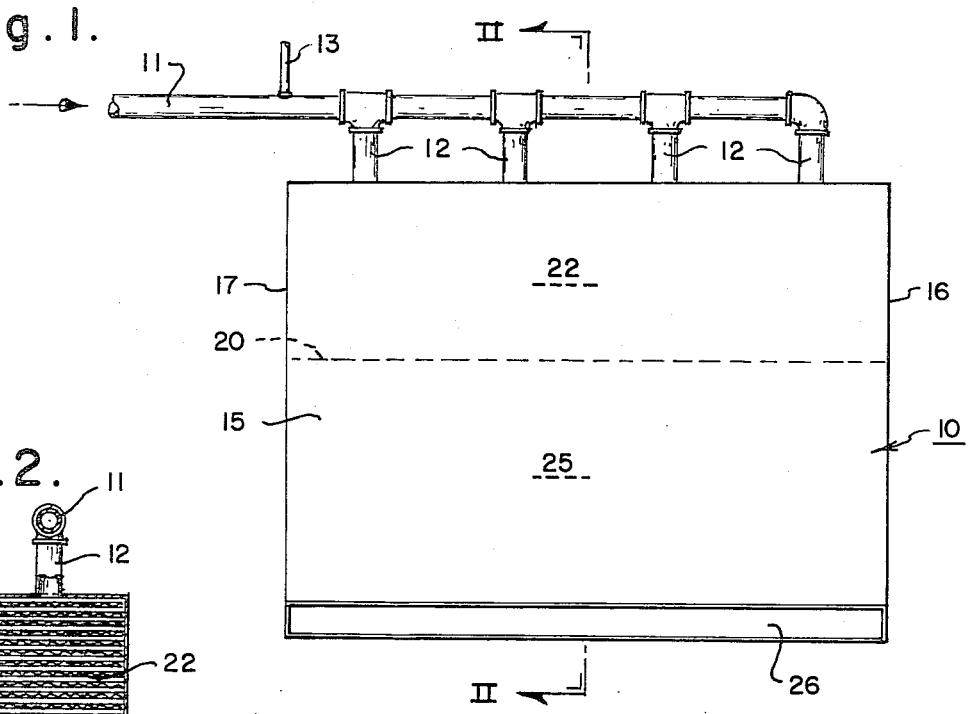
FIG. 1 is a side elevational view of an apparatus according to this invention from the effluent or tailings discharge.
Figure 2:
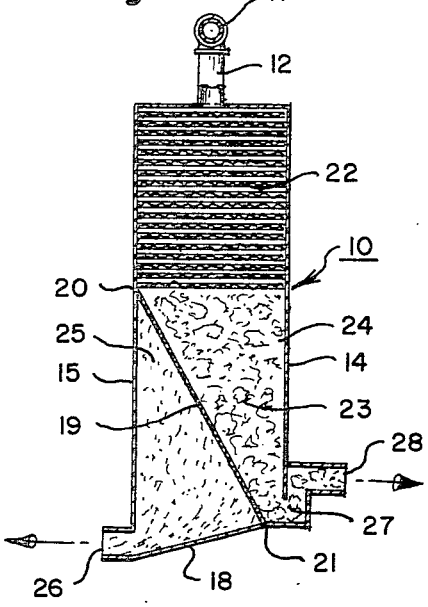
FIG. 2 is a section on the line II-II of FIG. 1.
Figure 3:
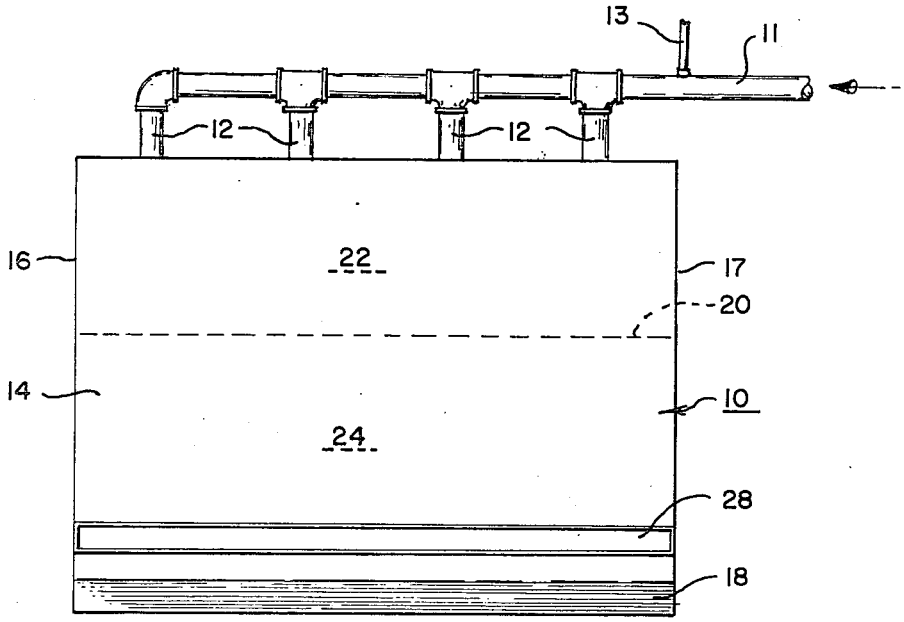
FIG. 3 is a side elevational view of the apparatus of FIG. 1 from the froth removal side.

Referring to the drawings I have illustrated a separation container 10, having an influent line 11 for delivering a suspension of mixed solids in liquid to be separated. The influent line has a multiplicity of discharge openings 12 extending along the length of container 10. A reagent inlet 13 is provided in the influent line ahead of discharge openings 12 through which frothing and like reagents may be added to the suspension in line 11.

The separation container 10 is generally rectangular in shape having spaced generally parallel opposite side walls 14 and 15, generally parallel end walls 16 and 17, and a bottom 18. A cross flow screen 19 extends between end walls 16 and 17, diagonally across container 10 from a line 20 intermediate the top and bottom of side wall 15 to a line 21 on bottom 18 adjacent its junction with side wall 14, at an angle of about 30° with wall 15. A plurality of superimposed ⅜" screens 22, about ⅜" apart, extend transversely across container 10 above line 20 and the suspension leaving openings 12 passes successively through these screens where it is agitated and aerated to form a froth. The froth 23 is collected on cross flow screen 19 in froth chamber 24 while the tailings in suspension pass through screen 19 into a discharge chamber 25 from which they are discharged through discharge slot 26. The froth 23 slides down screen 19 and passes through weir slot 27 and up to discharge opening 28 which is connected to a vaccum to cause the froth to be drawn from chamber 24.

The apparatus of this invention is simple, relatively small in size and highly efficient both in forming froth and separating the froth and its desired components from the tailings. No apparatus known to us can provide such efficient froth recovery as the instant invention.

In the foregoing specification I have set out certain preferred practices and embodiments of my invention; however, it will be understood that this invention may be otherwise embodied within the scope of the following claims.

I claim:

1. A froth separation apparatus comprising a stationary separation container of generally rectangular form having two spaced generally vertical side walls, two spaced generally vertical end walls, a bottom wall and a top, influent feed means delivering a suspension of solids in liquid into the interior of said container at spaced points along the top of said container, a reagent inlet into the influent feed means ahead of said container, generally diagonal froth retention planar screen means extending across the separation container from end to end and from a line intermediate the top and bottom of one side wall to a line adjacent the bottom of the other side wall, froth creating means in said container above said screen means, froth discharge means on the said other side wall adjacent the bottom thereof and adjacent and above the screen means line adjacent the bottom of said other side wall for removal of froth and outlet means at the bottom of said one side for tailings discharge.

2. A froth separation apparatus as claimed in claim 1 wherein the side walls are substantially parallel and the end walls are substantially parallel.

3. A froth separation apparatus as claimed in claim 1 or 2 wherein the froth discharge means includes a weir means.

4. A froth separation apparatus as claimed in claim 3 wherein the froth discharge is connected to vacuum means.

5. A froth separation apparatus as claimed in claim 4 wherein the froth creating means is a plurality of superimposed screens above the froth retention screen.

6. A froth separation apparatus as claimed in claim 1 or 2 wherein the froth creating means is a plurality of superimposed screens above the froth retention screen.

7. A froth separation apparatus as claimed in claim 1 or 2 wherein the froth retention screen lies at an angle of about 30° to said one wall to a line on the bottom adjacent the other wall.

8. A froth separation apparatus as claimed in claim 7 wherein the bottom wall slopes from said line on the bottom downwardly to said outlet means.

* * * * *